US005279047A

United States Patent [19]

Janecke

[11] Patent Number: 5,279,047

[45] Date of Patent: * Jan. 18, 1994

[54] LAUNDRY DRYER

[75] Inventor: Werner Janecke, Tübingen, Fed. Rep. of Germany

[73] Assignee: Zanker GmbH, Fed. Rep. of Germany

[ * ] Notice: The portion of the term of this patent subsequent to Aug. 11, 2009 has been disclaimed.

[21] Appl. No.: 880,738

[22] Filed: May 8, 1992

Related U.S. Application Data

[63] Continuation of Ser. No. 585,108, filed as PCT/DE90/00065, Feb. 1, 1990, Pat. No. 5,136,792.

[30] Foreign Application Priority Data

Feb. 3, 1989 [DE] Fed. Rep. of Germany ..... 3903183
Feb. 3, 1989 [DE] Fed. Rep. of Germany ..... 3903184
Feb. 18, 1989 [DE] Fed. Rep. of Germany ..... 3904988

[51] Int. Cl.[5] ..... F26B 21/06

[52] U.S. Cl. ..... 34/78; 34/133 J; 34/73

[58] Field of Search ..... 34/73, 76, 77, 78, 27, 34/133 J; 133 H; 165/111

[56] References Cited

U.S. PATENT DOCUMENTS 2,651,113 9/1953 Milby et al. ..... 34/78
3,739,487 6/1973 Clark ..... 34/77
4,621,438 11/1986 Lanciaux ..... 34/77
5,136,792 8/1992 Janecke ..... 34/73

*Primary Examiner*—Henry A. Bennet
*Assistant Examiner*—Denise L. Gromada
*Attorney, Agent, or Firm*—Harness, Dickey & Pierce

[57] ABSTRACT

A laundry dryer has an interior for holding laundry that is accessible via a door. Vapor-laden warm air from the interior, on the one hand, and a cooling medium, on the other, can be introduced into a condenser. The air and the cooling medium are brought into thermally conductive contact one with the other in the condenser to cool the air. In order to obtain the smallest possible outside dimensions relative to the usable interior and to be able to easily open the condenser or remove it from the laundry dryer for cleaning purposes, the condenser is arranged on an outer panel, preferably integrated in the door.

30 Claims, 9 Drawing Sheets

LAUNDRY DRYER

No. 585,108, filed as PCT/DE90/00065, Feb. 1, 1990, now U.S. Pat. No. 5,136,792.

The present invention relates to a laundry dryer comprising a housing having outer panels, as well as an interior for holding laundry, being accessible via a door, and further comprising a condenser into which vapor-laden warm air from the interior, on the one hand, and a cooling medium, on the other, can be introduced, being brought into thermally conductive contact one with the other in the condenser for cooling the air.

A laundry dryer of the above-described type is known from German Patent No. 2,923,701.

Laundry dryers of the above-described type, which are also termed "convection dryers" or "condensation dryers," are characterized by the fact that they have a closed-circuit internal air circulation system. In this air circulation system, heated air is advanced through the wet laundry by means of a fan and is then advanced to a condenser. In this condenser, the warm, vapor-laden air flows through a first cavity, which communicates with a second cavity in a thermally conductive manner via a partition. A cooling medium, such as tap water or cold ambient air, for example, flows through a second cavity. As a consequence of the cooling of the vapor-laden air, at least a large portion of the water vapor condenses to water, which is then drained into a disposed collecting vessel. The cooled air that egresses from the condenser is now reheated and again advanced through the wet laundry. In the case of condensation dryers of this type, a lint screen is generally arranged upstream of the condenser in order to prevent entrained lint from the dried laundry from collecting on the thermally conductive surfaces of the condenser and thus deteriorating the thermal transmission.

In the condensation laundry dryer that is known from German Patent No. 2,923,701 that was cited at the outset, the door is designed purely as a closure element and does not serve any purpose whatsoever in conjunction with the drying process. The warm air flows through the tumbler drum of the laundry dryer in a direction which is perpendicular to the door. A cavity is disposed between door and drum, in which the warm air is deflected downwardly in order to first flow through a lint screen which is arranged in horizontal alignment at approximately the height of the bottom edge of the door. The air is then deflected away to the rear by the front panel of the laundry dryer, and flows horizontally through a heat exchanger, behind which a fan is disposed. The air is again deflected upwardly by the fan, passes through a heating register, and is then deflected a fourth time to now again flow through the tumbler drum from back to front.

It is known practice in condensation laundry dryers to integrate the lint screen in the door, so that the vapor-laden warm air from the laundry drying area then flows through the lint screen in the door.

The condenser that is arranged beneath the tumbler drum in the known laundry dryer that was described at the outset has a thin, thermally conductive partition which is bent in an undulating configuration and which separates two cavities in the condenser one from the other. The heated, vapor-laden air from the interior of the laundry dryer flows through the one cavity, while cold outside air flows through the other cavity, for which purpose a further fan is disposed in the known laundry dryer. Both media flow in a direction that is parallel to the valleys that are formed by the undulating configuration of the partition, with the two media flowing in opposite directions.

In the known laundry dryer, the condenser can be arranged in an accessible manner so that it can be withdrawn from the chamber from time to time and can be very simply cleaned of the lint deposits However German Patent No. 2,923,701 does not indicate the details of how this is to be accomplished.

In the known laundry dryer, the condenser occupies a relatively large space beneath the tumbler drum.

Consequently, the outside dimensions of the laundry dryer are very large relative to the wet laundry capacity of the laundry dryer. As a result, it is often difficult or impossible to install a laundry dryer if space is confined in the home of the user, such as in small studio apartments of the type that are increasingly being occupied by single-individual households today.

A further disadvantage of the known laundry dryer is the fact that although, through the arrangement of the condenser beneath the tumbler drum, the condenser is accessible, significant design effort is nevertheless required in order to actually enable the condenser to be removed in such a simple manner in this unfavorable location that users without technical practice are also able to remove the condenser and to replace it in the laundry dryer again after it has been cleaned.

It is therefore the object of the present invention to further develop a laundry dryer of the type described at the outset in such a manner as to produce an extremely compact design, with the condenser additionally being accessible in an extremely simple manner. Moreover, a further object is to enable considerably smaller outside dimensions of the laundry dryer relative to the usable interior in that it is possible for the condenser to be installed with significantly smaller outside dimensions, without any change in heat-exchange performance.

This object is solved according to the present invention in that the condenser is arranged on one of tho outer panels.

The object upon which the present invention is based is solved completely in this manner. Thus, the present invention enables the requirement of providing the most compact design, in which, to a far greater extent, the outside dimensions of the laundry dryer are determined only by the desired laundry capacity of the laundry dryer, is possible due to the arrangement of the condenser on the outer skin.

With the present invention, it is therefore now possible, for the first time and in a previously unknown manner, to provide condensation laundry dryers whose outside dimensions are small, so that laundry dryers can now also be employed in those households in which this previously was not possible due to confined space in the kitchen or bathroom. Thus, for example, due to their compact design, laundry dryers according to the present invention can be hung on a wall, so that floor space in the kitchen or bathroom is no longer required.

If the condenser on the outer panel communicates with the exterior in a good thermally conductive manner, the outer skin is cooled. This cooling of the outer skin provides the advantage that, in addition to the employment of a cooling medium, the exterior, which is significantly cooler than the interior, is also utilized for removing the condensate from the vapor-laden warm air. This represents a considerable advantage over the prior art. In conventional laundry dryers, it is necessary for the entire heat-exchange process in the condenser to occur via the cooling medium, because the condenser is arranged deep in the interior of the laundry dryer housing. If tap water is employed as the cooling medium, this necessitates significant water throughput, and thus corresponding costs, while if outside air is employed as the cooling medium, a condenser of correspondingly large volume is required. In the laundry dryer according to the present invention that incorporates cooling of the outer skin, these disadvantages are significantly reduced in that the warm, vapor-laden air is subjected to the artificially added cooling medium, on the one hand, as well as to the coolness of the exterior that is available anyway, on the other. It is obvious that this represents a significant reduction in the cooling demand via the cooling medium, thereby enabling either the volume of cooling medium that is added or the dimensions of the condenser to be reduced.

It is especially advantageous for the outer panel to be the front panel of a door of the laundry dryer, with the condenser preferably being integrated in the door.

This practical example advantageously enables the condenser to be cleaned in an extremely simple manner, as the door of the laundry dryer is always an easily accessible element. In doing so, the present invention enables the contradictory needs for the most compact possible design, on the one hand, and easy accessibility of the condenser, on the other, to be united, as the arrangement of the condenser in the door allows an extremely compact design in which, to a far greater degree, the outside dimensions of the laundry dryer are now determined only by the desired laundry capacity of the laundry dryer Moreover, the present invention enables, in an elegant manner, the condenser to be removed and replaced again after cleaning in an extremely simple manner, as the door of the laundry dryer is an element that is always easily accessible.

In an especially preferred practical example of the present invention having collecting means for the condensed water which is separated from the cooled air, these collecting means are also integrated in the door.

This measure provides the advantage that, to this extent, as well, it is no longer necessary to provide any installation space for the collecting means within the laundry dryer housing, itself, as is the case in conventional laundry dryers. Depending upon whether or not this is practical in the individual instance, the collecting means integrated in the door can comprise merely the channels and lines that are required for catching and collecting the water, while a condensate collection vessel is arranged beneath the door; however, without departing from the scope of the present invention, it is also possible to integrate the condensate collection vessel in the door.

In a further preferred practical example of the present invention having a lint screen, through which the warm air is deflected, disposed upstream of the condenser, the lint screen is also integrated in the door in a known manner.

This measure provides the advantage that all elements of the laundry dryer to which access by the user is necessary for cleaning or similar purposes can now be swung down or removed together with the door of the laundry dryer and are thus accessible in an extremely easy manner.

In a preferred embodiment of the laundry dryer according to the present invention, the condenser is thermally insulated from the interior by means of an insulating panel.

This measure provides the advantage of enabling the heat-exchange process to take place within the condenser, completely independently of the conditions predominating in the interior of the laundry dryer. The thermally insulating panel thus enables the lines in the condenser to be routed relative to the interior or exterior independently of the current temperature in the interior of the laundry dryer, for example. This measure also avoids cooling of the laundry drying area by the cooling air flowing through tho condenser.

In a further preferred version of the present invention, the condenser, the lint screen and the insulating panel are arranged essentially parallel to a plane defined by the door.

This measure provides the advantage, as opposed to the known laundry dryer described at the outset, for example, of producing an extremely compact design, because the above-described elements of the laundry dryer are arranged one behind the other in a sandwich-like design, so that the thickness of conventional laundry dryer doors need only be increased insignificantly or not at all.

In an especially preferred practical example of a laundry dryer according to the present invention, comprising a condenser having a first cavity for advancing the warm air, a second cavity for advancing the cooling medium, as well as a thermally conductive partition of large surface area separating the cavities one from the other, the first cavity additionally communicates in a thermally conductive manner and throughout a large surface area with an exterior area surrounding the laundry dryer via a thermally conductive front panel of the door.

This cooling of the outer skin provides the advantage that, in addition to the employment of a cooling medium, the exterior, which is significantly cooler than the interior, is also utilized for removing the condensate from the vapor-laden warm air. This represents a considerable advantage over the prior art. In conventional laundry dryers, it is necessary for the entire heat-exchange process in the condenser to occur via the cooling medium, because the condenser is arranged deep in the interior of the laundry dryer housing. If tap water is employed as the cooling medium, this necessitates significant water throughput, and thus corresponding costs, while if outside air is employed as the cooling medium, a condenser of correspondingly large volume is required. In the above-described practical example of the laundry dryer according to the present invention, these disadvantages are significantly reduced in that the warm, vapor-laden air is subjected to the artificially added cooling medium, on the one hand, as well as to the coolness of the exterior that is available anyway, on the other. It is obvious that this represents a significant reduction in the cooling demand via the cooling medium, thereby enabling either the volume of cooling medium that is added or the dimensions of the condenser to be reduced.

The same applies analogously if, with the arrangement reversed, the second cavity additionally communicates in a thermally conductive manner and throughout a large surface area with an exterior area surrounding the laundry dryer via the thermally conductive front panel of the door.

This measure provides the advantage of being able to connect the first cavity, containing the warm, vapor-laden air, with the laundry drying area located therebehind in a simple manner. On the other hand, arrangement of the second cavity, containing the cooling air, on the front panel provides the advantage that the cooling air is constantly in communication with the cooling exterior and can therefore constantly be kept at a lower temperature as it passes through the condenser.

In a further preferred embodiment of the laundry dryer according to the present invention comprising a condenser that is divided into two cavities, in which the partition is of undulating configuration and the warm air and the cooling medium are advanced in a direction that is essentially parallel to the valleys of the partition, the partition is arranged against a thermally conductive front panel of the door in such a manner that its protrusions are in a contacting relationship therewith.

This measure provides the advantage of additionally cooling the thermally conductive partition through direct thermal coupling to the exterior, resulting in a further increase in the efficiency of the condenser.

In this practical example, it is especially advantageous for the partition to be of flattened configuration in the area of the protrusions for the purpose of establishing a contacting relationship of large surface area with the front panel.

This measure provides the advantage of achieving especially good thermal coupling of the partition to the exterior.

The same applies analogously if, in another version of the above-described practical example, the partition is fabricated in one piece together with the front panel in the area of the protrusions for the purpose of establishing a contacting relationship of large surface area with the front panel.

This measure provides the advantage of producing an arrangement that can be more readily fabricated, especially if plastics fabrication processes are employed.

In a further group of practical examples of the present invention, the second, or alternatively the first, cavity is formed by tubes which extend through the first, or alternatively the second, cavity.

This measure provides the advantage of creating a condenser that can also be fabricated in a simple manner, as the preferably cylindrical tubes can be fabricated in a simple manner. This also provides the advantage of creating a very large thermal transmission surface area, as the entire surface area of the tubes extends through the respectively other cavity.

In a preferred further development of this practical example, the air flows radially against the tubes from the exterior.

This measure provides the advantage of creating especially good thermal transmission through the walls of the tubes, as the flow is swirled considerably due to the radial direction of this flow.

In a further development of this version, the air flows radially against the area of one end of the tubes from the exterior, the flow is deflected in an axial direction, flows axially along the tubes, is again radially deflected, and then flows away from the tubes in this radial direction.

This measure provides the advantage of creating a compact condenser, in which it is not necessary to dispose any structural measures beyond the axial ends of the tubes to allow the above-described flow to flow against or from the tubes.

A further preferred version of the multitubular surface condenser consists of forming the condenser from a battery of tubes, with the tubes being disposed adjacent one to the other with widened ends, while sections thereof extending between the widened ends display interspaces one between the other.

This measure provides the advantage of creating a compact condenser with a large thermal transmission surface area.

In this connection, it is especially preferred if, in a known manner, the radial cross sections of the widened ends are of hexagonal configuration.

This measure provides the advantage of creating a mechanically stable and air-tight formation at the axial ends of the tubes if the hexagonal (or square) ends are assembled in the form of a honeycomb.

In the practical examples comprising a multitubular surface condenser, it is very especially preferred for the multitubular surface condenser to form a single-piece plastic component with the door of the laundry dryer.

This measure provides the advantage of creating an extremely compact, lightweight design that is favorable to fabricate.

In still another group of practical examples of the present invention, in which the cooling medium is air and a blower is disposed for the air, the blower is also integrated in the door.

This measure provides the advantage of enabling an even more compact design of the laundry dryer, as the actual interior of the laundry dryer behind the door is essentially completely freed of the components of the cooling air circulation system. It provides the further advantage that the cooling air routing system has no impact whatsoever on the other elements of the laundry dryer, especially the laundry drying area, as it is not necessary for any of the low-temperature cooling air ducts to be run along the vicinity of the laundry drying area. If the fan is integrated in the door and the cooling air inlet and/or outlet is arranged on the front side of the door, the additional benefit is provided that no sealing problems whatsoever are created in the cooling air line, as it is not necessary for any detachable connection elements to be disposed in the cooling air line. The above-described measures provide the advantage over conventional laundry dryers, in which the drum drive is simultaneously exploited for moving the cooling air, of relieving the drum drive of the function of advancing the cooling air and therefore enabling it to be designed with a smaller rating and thus with smaller dimensions. This also enables the drum to be symmetrically reversed to provide better drying uniformity, as decoupling the drive of the drum, on the one hand, and the cooling air circulation system, on the other, obviates the need for having to take into consideration in the cooling air circulation system the fact that it is necessary for the drive of the drum to operate in a reversible manner. This also produces more uniform distribution of the cooling air in the cooling air circulation system, and this, in turn, results in smaller dimensions of the condenser.

The same also essentially applies analogously if, in a further practical example of the present invention, in which air is the cooling medium and a fan is disposed for advancing the air, the fan is integrated in the housing of the laundry dryer above the door.

While this practical example of the present invention does produce a somewhat more complicated line routing in the area of the cooling air circulation system, all of the above-described advantages that result from the separation of the drive functions with respect to the drum and the cooling air circulation system are retained.

In both of the above-described practical examples of the present invention, it is preferable to employ an extraction fan, especially an axial-flow fan.

This measure provides the advantage of being able to advance a large volume of air with low pressure in tho cooling air circulation system, as is desirable for the cooling purposes of the condenser. Integration of the fan in or on the door of the laundry dryer naturally results in very short cooling air lines, thus enabling the system to operate with low pressure while nevertheless enabling a large volume of air to be advanced, as opposed to conventional laundry dryers, in which the complicated line routing of the cooling air circulation system necessitated a relatively high delivery pressure as a result of its aerodynamic resistance.

The above discussed and other objects, features and advantages of the present invention will become more apparent from the following description thereof, when taken in connection with the practical examples shown in the accompanying drawings, in which.

FIG. 1 shows a perspective, highly schematicized overall view of a practical example of a laundry dryer according to the present invention;

FIG. 1*a* shows an overall view similar to that shown in FIG. 1, to explain an outer skin cooling concept;

Figure 1:
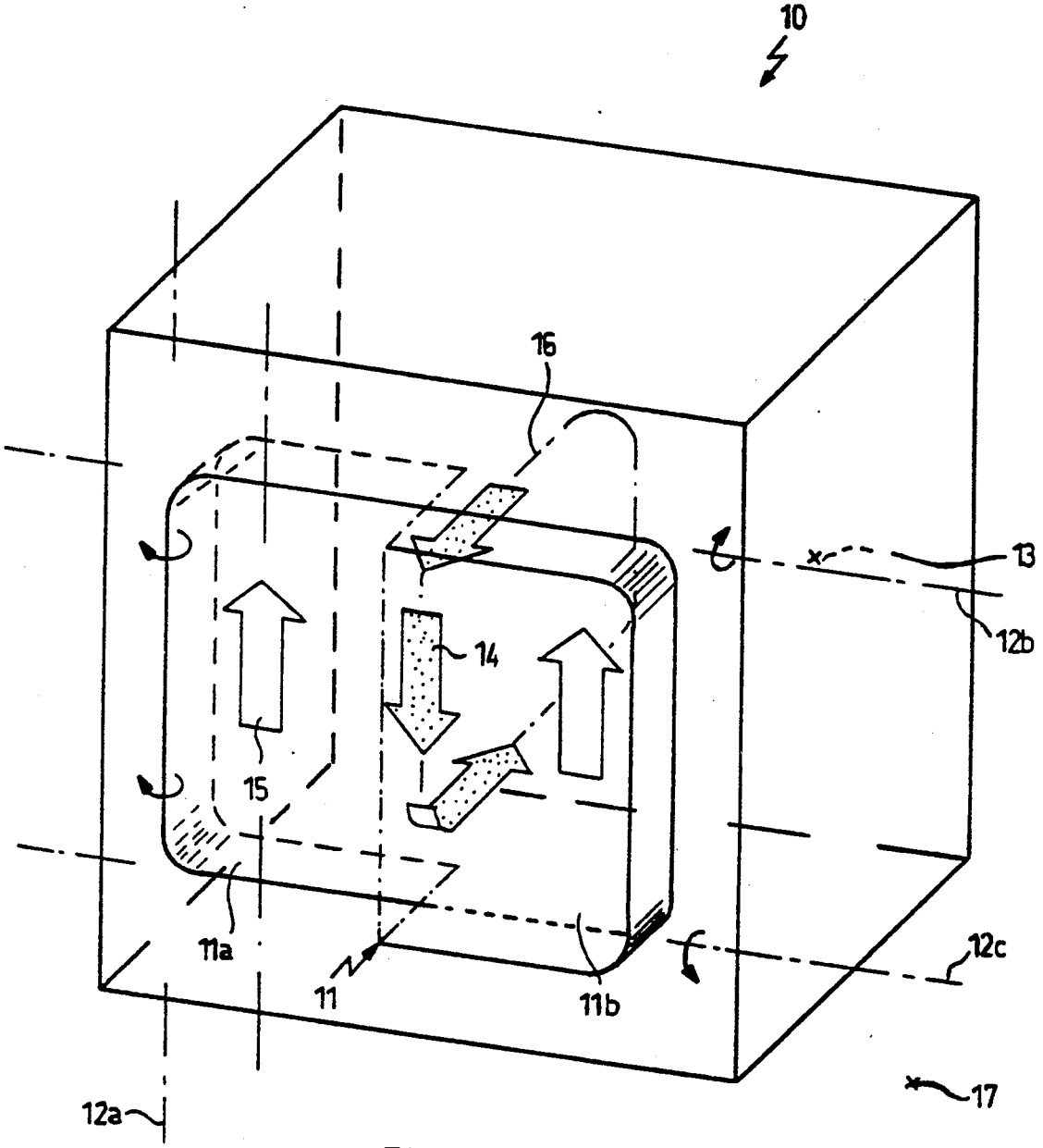

Referring now to the drawings, where like reference numerals designate like parts throughout the several views, 10 in FIG. I denotes an entire convention type laundry dryer having a more or less cube-shaped housing. The depth and height of the housing are of relatively shallow design. In this connection, the fact should be taken into consideration that laundry dryers of the customary type have a depth of 60 cm in order to enable them to be integrated into customary kitchen furniture. The present invention, on the contrary, strives to significantly reduce the installation depth to 38 or 40 cm, for example.

The front side of laundry dryer 10 displays a door 11, which can be pivoted about a vertical axis 12 As shown at 11*a* in the left half of FIG. 1, door 11 can be integrated in the housing of laundry dryer 10, thus producing a flush arrangement on the front side of laundry dryer 10. Alternatively, however, it is also possible to surface-mount door 11 on the front panel of laundry dryer 10, as suggested in the right half of FIG. 1. In both cases, it is also possible for door 11 to pivot about a horizontal axis, which can be arranged in the vicinity of the top of the door, as suggested by 12*b* in FIG. 1, or below door 11, as suggested by 12*c* in FIG. 1.

In laundry dryer 10, the interior, filled with moist laundry, is denoted in highly schematicized form by 13. Arrows 14 denote the flow of warm, vapor-laden air, while opposite arrows 15 symbolize the flow of a cooling medium such as ambient air. 16 suggests that warm air 14 circulates. Cooling air 15, on the contrary, is taken from an exterior area 17 surrounding laundry dryer 10 and blown back thereinto. An exchange of heat occurs between warm air 14 and cooling air 15, without these two media intermingling one with the other. As can already be seen from the schematic representation in FIG. I, the heat-exchange process between warm air 14 and cooling air 15 occurs in the area of door 11.

Figure 1A:
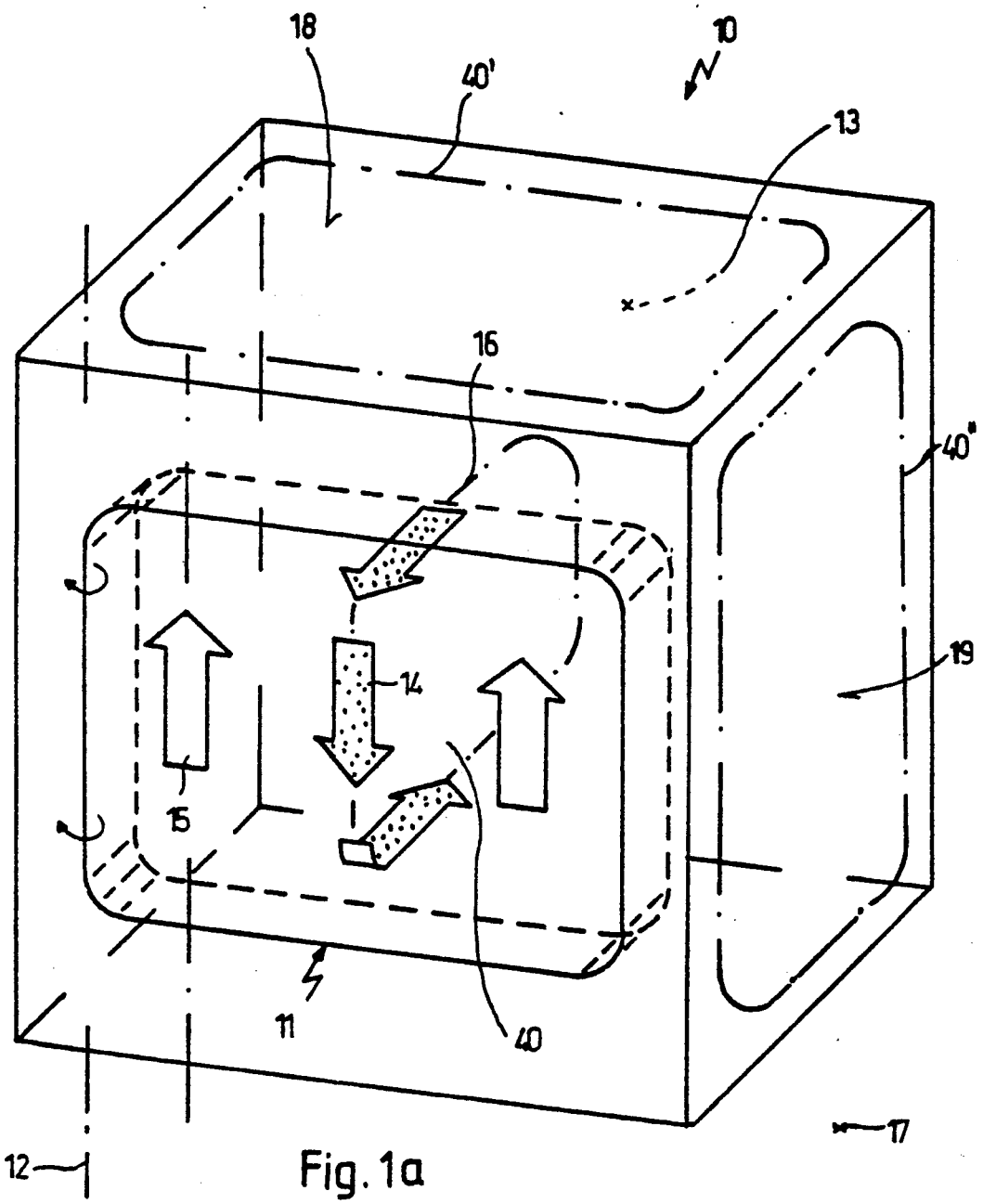

In FIG. 1*a*, the heat-exchange process between cooling air 15 and warm, vapor-laden air 14 that occurs in the area of door II is further symbolized by a condenser 40 disposed there, whose structural details will be explained in detail below. These further explanations will clearly show that an advantageous design feature of condenser 40 can consist of the cavity of condenser 40 through which warm air 14 flows not only communicating with a further cavity in condenser 40 through which cooling air 15 flows in a manner that offers good thermal conductivity and a large surface area Moreover, it is also possible for a further surface of the cavity in condenser 40 through which warm air 14 flows to communicate with exterior area 17 in a manner that offers a large surface area and good thermal conductivity in that condenser 40 is thermally coupled directly to the outer skin of laundry dryer 10

Nor is it necessary for condenser 40 to be disposed in door 11 of laundry dryer 10. In preferred versions of the present invention, it is also possible for the condenser to be arranged in a cover panel 18, as suggested by 40', or in a side panel 19, as suggested by 40'', or in any other defining panel of laundry dryer 10. In fact, the latter two instances would result in the advantage of providing a large surface area for thermally conductive contact with the outer skin of laundry dryer 10, as door 11 naturally encompasses only a portion of the front panel of laundry dryer 10. In all instances, condenser 40, 40', 40'' can be of cartridge-type design in order to allow it to be removed from door II or a defining panel of laundry dryer 10 in a simple manner, for example by withdrawing it.

Figure 2:
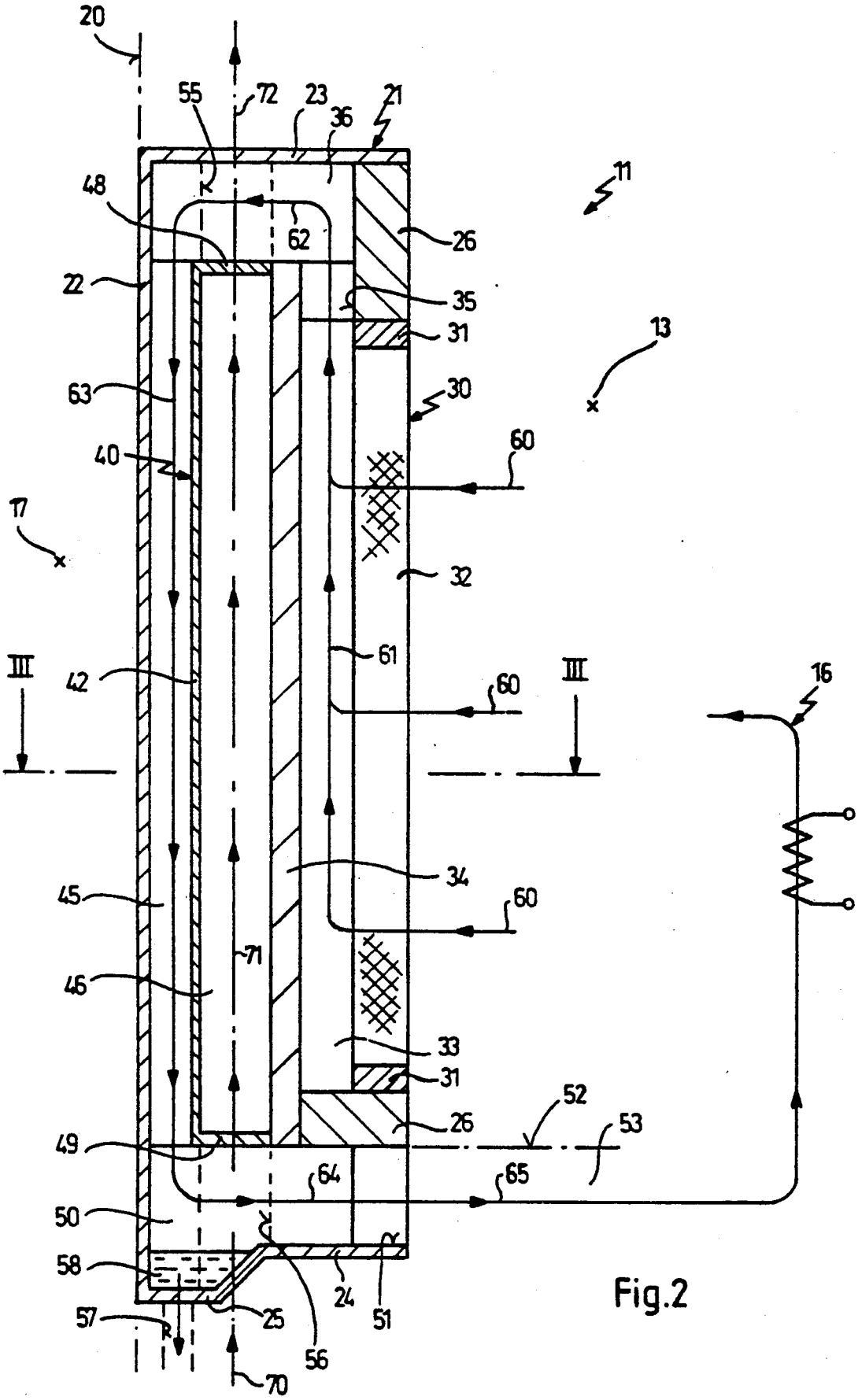
FIG. 2 shows a sectional side view, taken along Line II—II in FIG. 3, through the door of the laundry dryer according to FIG. 1.
Figure 3:
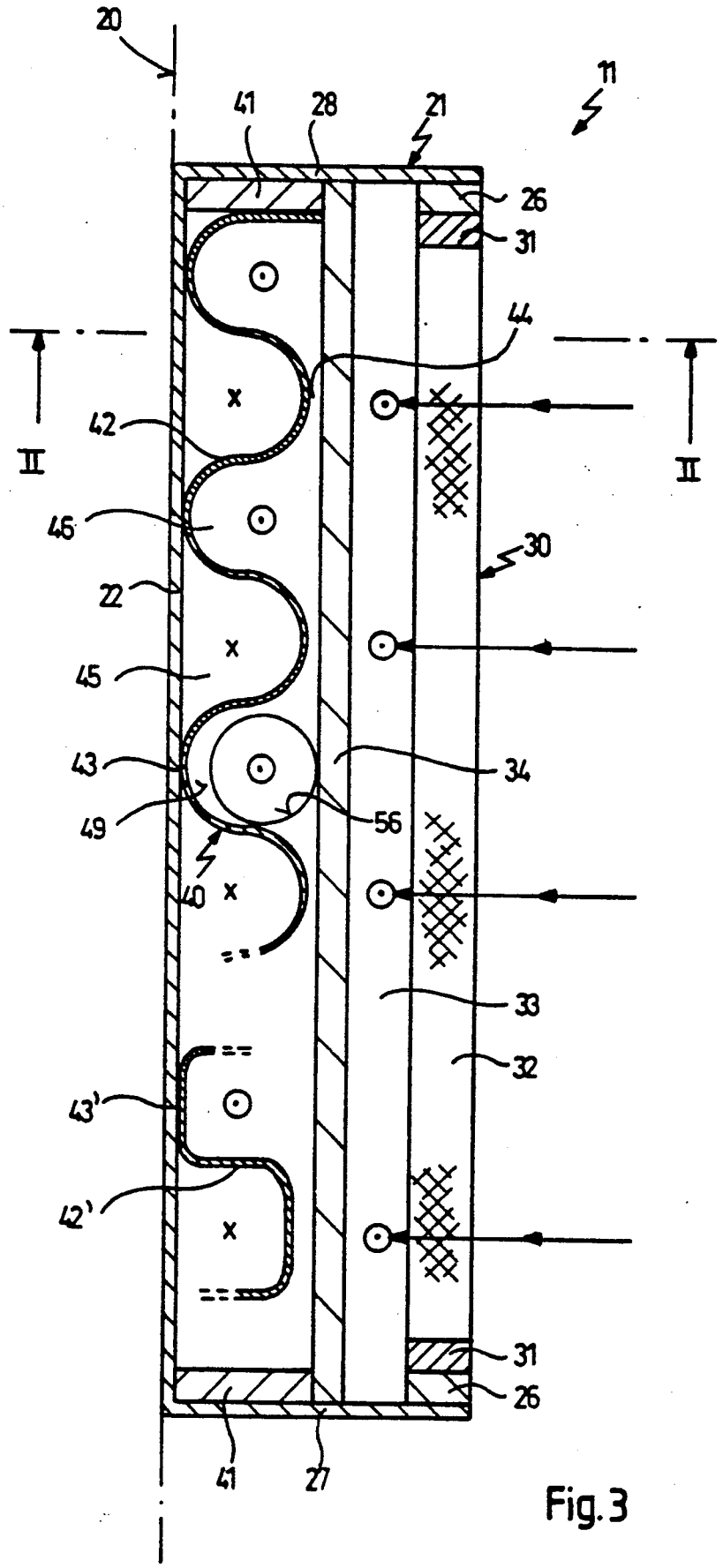
FIG. 3 shows a sectional top view, taken along Line III—III in FIG. 2, through the door of the laundry dryer according to FIG. 1.

In this connection, FIGS. 2 and 3 show further details in two sectional representations, taken perpendicular one manner in which door 11 functions.

Door 11 is recessed into a front panel 20 of laundry dryer 10 (11*a* in FIG. I) or surface-mounted thereon (11*b* in FIG. 1). It comprises an essentially box-shaped housing 21 having a front panel 22, a top panel 23 and a bottom panel 24. A drain channel 25 is integrated in bottom panel 24; drain channel 25 can be designed either as a collecting channel for a condensate or, by means of an appropriate, drawer-type insert, as a collecting vessel for the condensate.

A rear panel 26 of housing 21 is designed as a peripheral frame. Laterally, housing 21 is defined by a right panel 27 and a left panel 28, which can be clearly seen from FIG. 3.

Housing 21 can be fabricated entirely of metal or plastic. For practical examples of the present invention, it is important that front panel 22 possess good thermal conductivity. For this purpose, front panel 22 is preferably designed of metal or as a very thin-walled plastic element. Although housing 21 with panels 22 to 24 and 26 to 28 can be combined from a plurality of individual components of different materials, an embodiment is preferred in which housing 21 and interior functional components are designed as one-piece plastic components, fabricated through modern blow-molding technology.

Disposed in rear panel 26 is a lint filter 30, comprising a mechanically stable frame 31 and a filter element 32. Lint filter 30 can be removed from rear panel 26 by means of unillustrated guide means, for example, which enable lint filter 30 to be horizontally or vertically withdrawn, inserted, engaged or swivelled into place. It is obvious that panels of housing 21, such as right panel 27 and/or left panel 28, can be designed as swing-down, slide-in, engaging or pivotable elements for cleaning or maintenance purposes.

It is preferable for lint filter 30 to be arranged in rear panel 26 in such a manner that lint filter 30 is flush with the rear panel of door 11. Located behind lint filter 30, as viewed from interior 13, is a first cavity 33, whose vertical extension in the vertical plane of door 11 is essentially the same as that of filter element 32. In this connection, "flush" is also meant to include an instance in which the lint screen is slid into a dish-shaped projection on the interior of the door, which simultaneously serves as a laundry deflector.

Adjacent to first cavity 33 is an insulating panel 34 which defines first cavity 33 against the other side. Disposed in rear panel 26, which simultaneously serves as a holder for lint filter 30 and insulating panel 34, in the vicinity of upper panel 23 is a vertical first passage 35, which branches from first cavity 33. First passage 35 leads to a second cavity 36 beneath top panel 23.

Disposed between insulating panel 24 and front panel 22 of housing 21 is a condenser, which is denoted 40 in its entirety. Condenser 40 displays at least one frame 41 having lateral frame legs, between which a partition 42 is enclosed in an air-tight manner. As can clearly be seen from FIG. 3, partition 42 is of undulating configuration. Partition 42 is arranged against front panel 22. In the practical example illustrated in the top half of FIG. 3, partition 42 has hollow-cylinder-shaped rounded protrusions, which are in a thermally contacting relationship with front panel 22 along lines of contact 43.

In the practical example illustrated in the bottom half of FIG. 3, on the contrary, the protrusions of undulating partition 42' are of flattened design, so that they are in a thermally contacting relationship with front panel 22 along lines of contact 43'. Consequently, thermal transmission is better in the case of partition 42' than in the case of partition 42.

On the opposite side, partition 42 is arranged in front of insulating panel 34, preferably at a clearance 44 therefrom.

As a result of the above-explained arrangement of partition 42, third cavities 45 are formed on the side facing front panel 22 and fourth cavities 46 on the side facing insulating panel 34. Fourth cavities 46 are enclosed at the top and bottom by means of terminating panels 48 and 49, respectively, so that second cavity 36 communicates exclusively with third cavities 45. The bottoms of third cavities 45 open into a fifth cavity 50 above lower panel 24. Fifth cavity 50, in turn, opens into a second passage 51, which extends horizontally through rear panel 26.

A first connection 55 is attached to upper terminating panel 48 and a second connection 56 to lower terminating panel 49. Connections 55, 56 open into top panel 23 and bottom panel 24, respectively.

In practical examples of the present invention, finally, a third connection 57 is attached to drain channel 25 to advance water of condensation 58 to an unillustrated collecting vessel. However reference is again made at this point to the fact that drain channel 25, in turn, can contain a collecting vessel, which would obviate the need for third connection 57 in this case.

The theory of operation of the arrangement according to FIGS. 2 and 3 is as follows:

60 denotes a portion of first warm airflow 14, which is extracted as warm, vapor-laden air from interior 13, i.e. that area of laundry dryer 10 which is filled with wet laundry.

First airflow 60 passes through lint filter 30 to enable lint from the laundry that is entrained in airflow 60 to be captured At 61, the first airflow is deflected upwardly 90| and passes through first cavity 33 and first passage 35. At 62, the first airflow then passes through second cavity 36 and is deflected downwardly 90° prior to reaching front panel 22. At 63, the first airflow then passes through third cavity 45, to then be deflected 90° to the horizontal plane again in fifth cavity 50, and is advanced through second passage 51 at 64 and out of door 11 again. At 65, the airflow is then located in an extraction duct 53 beneath a base 52 of interior 13. An extraction fan can be arranged in extraction duct 53 in a known manner in order to maintain first airflow 14. During the course of its closed-circuit circulation system 16, air-flow 14 now passes a heating register at 65 and is returned to interior 13.

In contrast thereto, a portion 70 of second airflow 15 is generated by an unillustrated fan; portion 70 of second airflow 15 is introduced to second connection 56 and then flows through fourth cavity 46 at 71, to then again leave door 11 through first connection 55. Here, too, the air connections arranged in the housing of laundry dryer 10 and adjacent to door il are not individually illustrated.

Opposing airflows 63 and 71 in third cavities 45 and fourth cavities 46, in conjunction with partition 42, with its very large surface area, produce a good heat-exchange effect. The cool ambient air which is advanced upwardly through fourth cavities 46 cools the warm, vapor-laden air of closed-circuit circulation system 16 which is advanced downwardly through third cavities 45. Consequently, the vapor is removed in the form of water of condensation 58 and drips down into drain channel 25, from where water of condensation 58 advances via third connection 57 to a collecting vessel which is recessed in front panel 20 of laundry dryer 10 beneath door 11, unless the collecting vessel is arranged within drain channel 25, itself It is additionally possible for drain channel 25 or a collecting vessel to be designed in such a manner that these elements have a downwardly pointing drain valve If, namely, the laundry dryer is mounted on the wall above a bathtub in a bathroom, for example, the water of condensation can be drained downwardly, directly into the bathtub (or a washbasin or a drain) by opening the drain valve, without having to remove a collecting vessel from the laundry dryer.

In addition, in the case of the arrangement shown in FIGS. 2 and 3, warm, moist airflow 63 which is advanced downwardly through third cavities 45 is cooled not only by the inside of door 11 via thermally conductive partition 42, but additionally by the outside of door 11 via thermally conductive front panel 22 of housing 21. As a result of this very large heat-exchange surface area, airflow 63 can be cooled so greatly, in spite of the relatively small dimensions of condenser 40, that all of the vapor occurs essentially in the form of water of condensation 58.

What has already been said above with respect to housing 21 also applies with respect to condenser 40 to the extent that, while condenser 40 can also be designed from multiple components and from different materials, it is preferable here, too, for it to be designed as a single-piece plastic component by means of blow molding, whereby it is preferable for condenser 40 to be designed predominantly as one piece together with housing 21, itself.

In this connection, it should be understood that the airflow advancement in the area of fourth cavities 46 that is illustrated in FIGS. 2 and 3 is shown by way of example only.

Thus, clearances 44 are provided in the illustrated practical example in order to produce better distribution of the air in the area of fourth cavities 46. Instead of this, however, it would also be possible for the airflows to enter fourth cavities 46 individually via connections 55, 56, either vertically as illustrated in FIGS. 2 and 3 or horizontally, in that a lower and an upper portion of rear panel 26 come into a contacting relationship with a corresponding mating surface of the housing of laundry dryer 10 when door II is closed.

The characteristics of heat exchanger 40 that have been described above on the basis of FIGS. 2 and 3 also apply in the same manner if heat exchanger 40 is not installed in door 11, but in another area of the outer skin of laundry dryer 10, as was suggested by 40' and 40" in FIG. 1*a*.

Because the components of laundry dryer 10 according to the present invention can be designed very small relative to the usable interior 13 and because plastic components, in particular thin-walled plastic components, are employed wherever possible, laundry dryer 10 according to the present invention is also very light in weight It is therefore possible to dispose suitable fittings on laundry dryer 10 to enable it to be hung from a wall.

Figure 4:
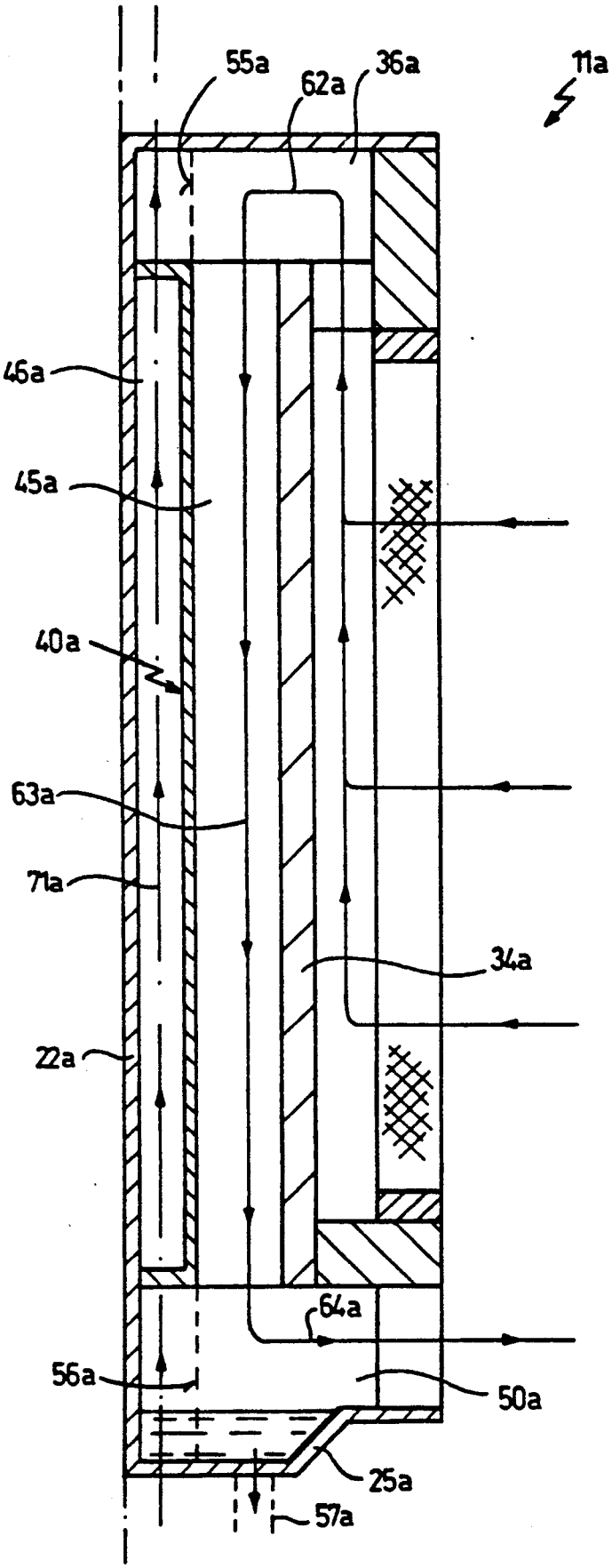
FIG. 4 shows a representation similar to FIG. 2, however for a further practical example of the present invention.

FIG. 4 shows still another practical example of a door in a representation similar to that shown in FIG. 2, in which similar elements are denoted by the same reference numerals, with an "a" merely being added Essentially, the difference between the practical example according to FIG. 4 and that according to FIGS. 2 and 3 is that the locations of third and fourth cavities 45*a*, 46*a* are reversed relative to the locations thereof in FIGS. 2 and 3. Thus, in the practical example shown in FIG. 4, airflow 63*a* of closed-circuit circulation system 16 is advanced directly behind insulating panel 34*a*, while airflow 71*a* of the cooling circulation system is located behind front panel 22*a*. Consequently, connections 55*a*, 56*a* are arranged directly behind front panel 22*a*, i.e. outside of first airflow 62*a* and 64*a* in second cavity 36*a* and fifth cavity 50*a*, respectively. This results in a simpler routing of the air.

Since third cavity 45*a* has been relocated away from front panel 22*a*, in the practical example according to FIG. 4 it is also necessary for drain channel 25*a* to be designed somewhat wider as viewed from the side.

Because the components of laundry dryer 10 according to the present invention can be designed very small relative to usable interior 13 and because plastic components, in particular thin-walled plastic components, are employed wherever possible, laundry dryer 10 according to the present invention is also very light in weight. It is therefore possible to dispose suitable fittings on laundry dryer 10 to enable it to be hung from a wall.

Figure 5:
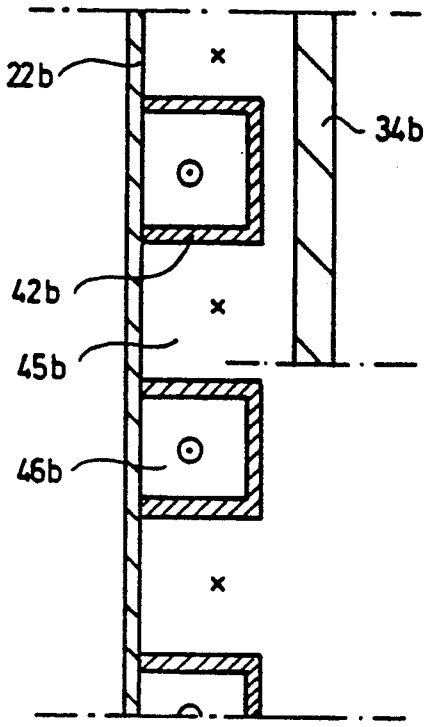
FIG. 5 shows a representation similar to FIG. 3, however only a portion thereof and for another practical example of the present invention.

FIG. 5 shows a further version of the condenser, in which partitions 42*b* for defining fourth cavity 46*b* or a plurality of fourth cavities 46*b* are designed only in sections. In this practical example, the protrusions of the undulating partition are thus formed by front panel 22*b*, itself.

In the practical example shown in FIG. 5, the cooling air flows through fourth cavities 46, while the warm, vapor-laden air flows through third cavity 45*b*, outside partitions 42*b*.

In this case, it is also possible, for example, to eliminate insulating panel 34*b*, as suggested in the lower half of FIG. 5. In this case, third cavity 45*b* would be defined from the interior of the laundry dryer by the lint screen.

Figure 6:
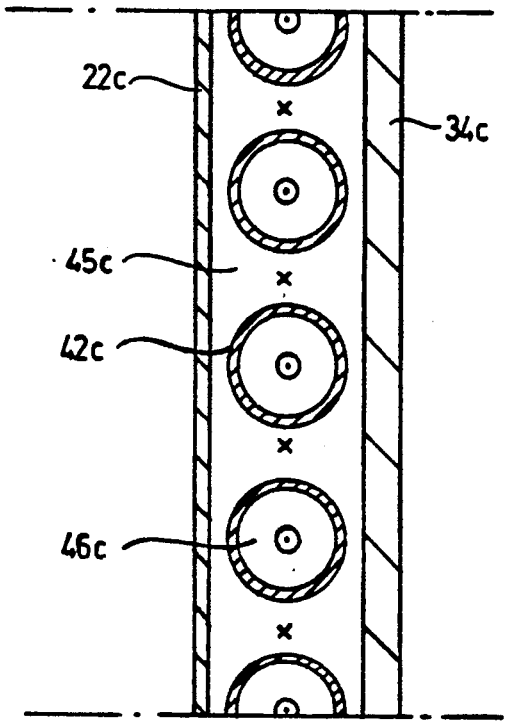
FIG. 6 shows a representation similar to FIG. 5, however for still another practical example of the present invention.

In a further version of the present invention according to FIG. 6, partition 42*c* is designed in the form of individual tubes which extend through third cavity 49*c*. In the illustration shown in FIG. 6, cooling air flows through fourth cavities 46*c* which are defined by tubular-shaped partitions 42*c*; however it is obvious that the warm, vapor-laden air could also alternatively be advanced through fourth cavities 46*c*. It is further obvious that the practical example shown in FIG. 6 can alternatively be accomplished either with or without insulating panel 34*c*.

Figure 7:
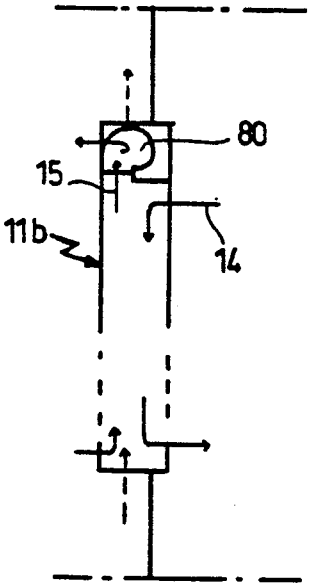
FIG. 7 shows a highly schematicized sectional side view through a further practical example of a laundry dryer according to the present invention.

In the practical example shown in FIG. 7, door 11*b* is axial-flow fan 73 for circulating cooling air 15 is arranged in the upper area of door 11*b*. As illustrated by solid arrows in FIG. 7, the cooling air can be sucked in and blown out through the front of door 11*b*; however the dashed arrows alternatively illustrate that the cooling air can also ingress and egress via the lower or upper narrow side, respectively, of door 11*b*.

Figure 8:
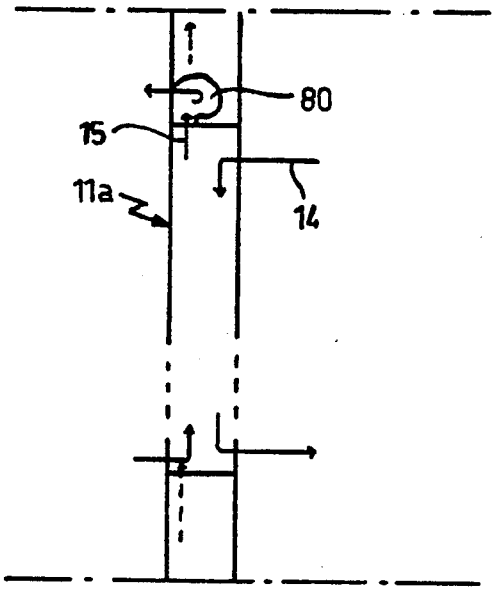
FIG. 8 shows a version of the representation according to FIG. 7.

In the version shown in FIG. 8, door 11*a* is integrated in the housing of the laundry dryer and its front side is essentially flush therewith.

Although axial-flow fan 73 can be integrated in the door in this practical example, as well, FIG. 8 shows the alternative case, in which axial-flow fan 73 is integrated above door 11*a* in the housing of the laundry dryer. In this case, as well, axial-flow fan 73 sucks cooling air 15 through the condenser; once again, the cooling air can ingress and egress via the front side of door 11*a* or the housing, or the cooling air can be routed within the housing, as suggested by dashed arrows in FIG. 8.

Figure 9:
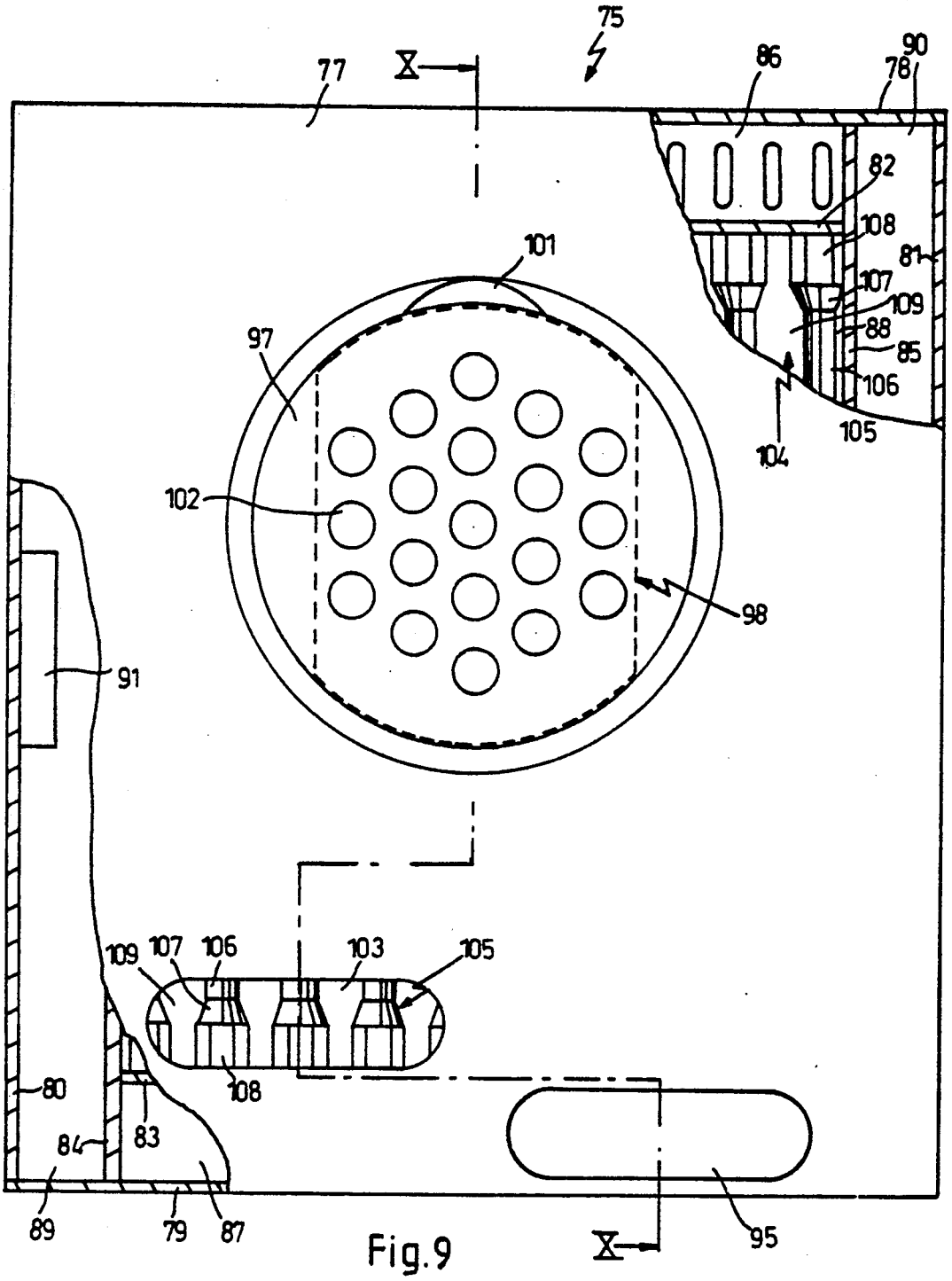
FIG. 9 shows a front view, as seen from the rear, of a practical example of a door of a laundry dryer according to the present invention.
Figure 10:
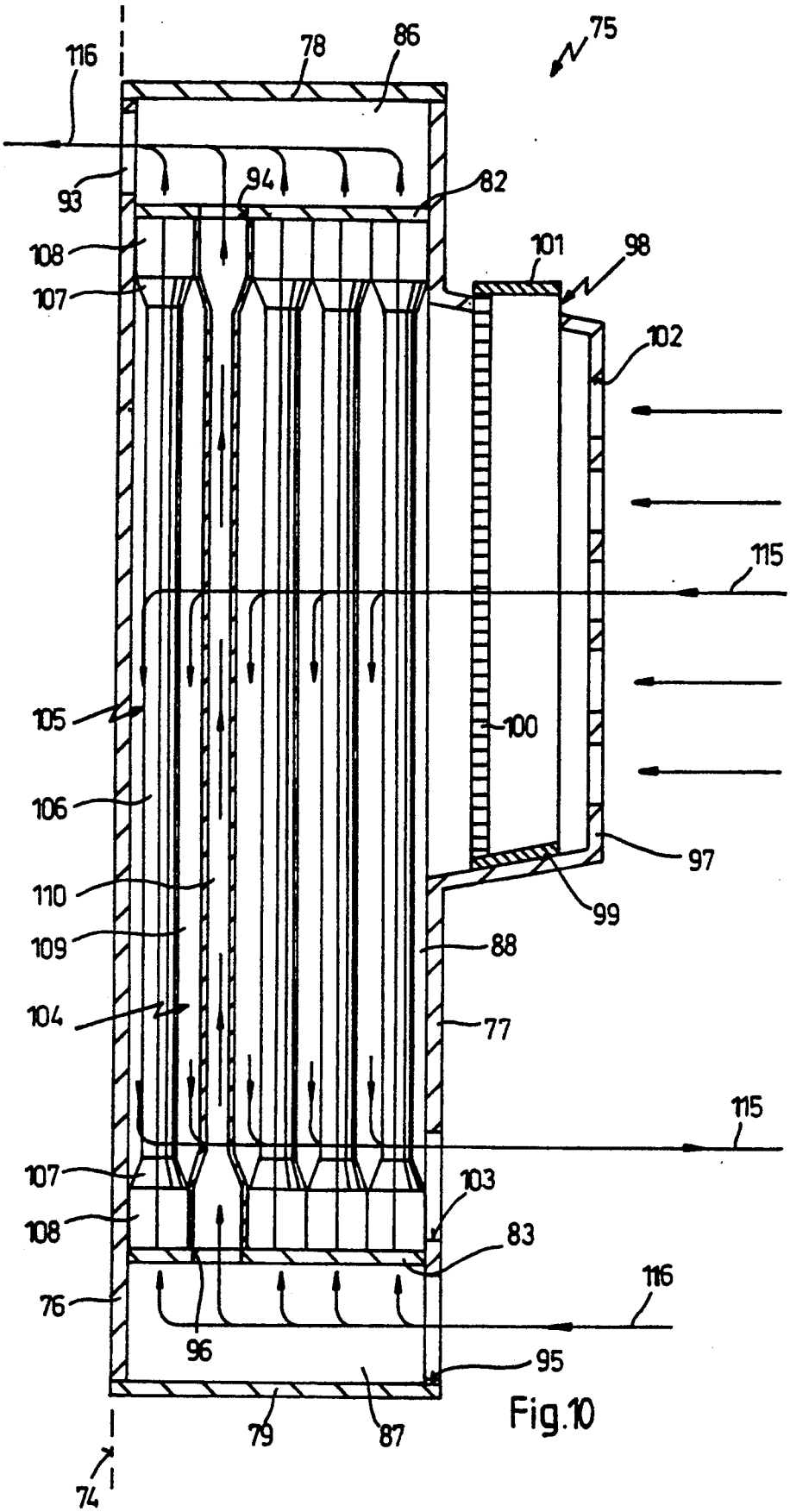
FIG. 10 shows a sectional side view, taken along Line X—X in FIG. 9.
Figure 11:
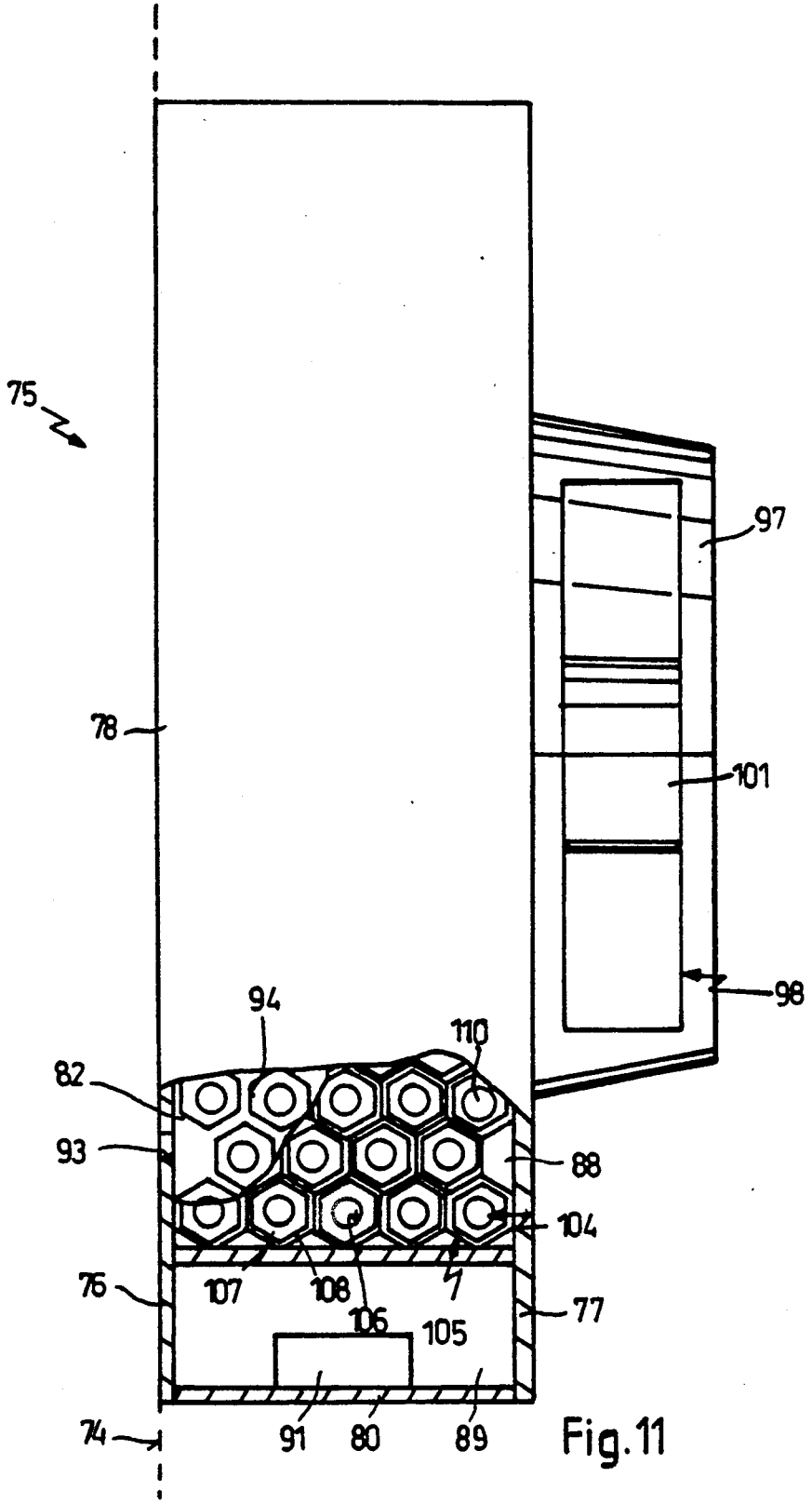
FIG. 11 shows a top view of the door according to FIGS. 9 and 10.

A further practical example of the present invention, in which the condenser is integrated in the door of the laundry dryer, is shown in FIGS. 9 to 11. In the practical example shown in FIGS. 9 to 11, as well, it is obvious that the entire door and condenser unit can be designed as a lightweight plastic component, preferably as a single-piece component, in which modern technologies are employed to fabricate thin-walled plastic components, e.g. the above-mentioned blow-molding technology to fabricate the door housing, while the condenser components can also be fabricated by means of other techniques.

In the practical example shown in FIGS. 9 to 11, a door 75 is arranged in a front panel 74 of the laundry dryer. Door 75 has a box-shaped housing, with a front panel 76, a rear panel 77 parallel thereto, top and bottom side panels 78, 79, as well as right and left side panels 80, 81, whereby "right" and "left" are taken to mean as viewed from the front in each case, i.e. from the opposite side of the view shown in FIG. 9.

The cube-shaped housing of door 75 formed by panels 76 to 81 is further divided by means of an upper horizontal partition 82 and a lower horizontal partition 83, whereby above-indicated partitions 82, 83 extend horizontally between two vertical partitions, namely a right vertical partition 84 and a left vertical partition 85.

Each of horizontal partitions 82, 83 extends to the vicinity of upper and lower partition 78, 79, respectively. This produces a shallow upper air plenum 86, as well as a shallow lower air plenum 87. These air plenums, as well as a large condenser chamber 88 disposed therebetween, thus do not extend across the entire width of door 75, but extend only between vertical partitions 84 and 85. The remaining chambers, i.e. a right chamber 89 and a left chamber 90 between vertical partitions 84, 85 and respectively adjacent right and left side panels 80, 81, are employed for housing a lock 91, for example, as well as unillustrated hinges in left chamber 90.

Upper air plenum 86 communicates aerodynamically with the exterior via a plurality of vertically extending slits 93. In addition, it also communicates with condenser chamber 88 via openings 94 in upper horizontal partition 82.

Lower air plenum 87 communicates with the interior of the laundry dryer via an inlet opening 95, which is arranged eccentrically to the center on the right-hand side of door 75 in rear panel 77. Moreover, lower air plenum 87 also aerodynamically communicates with condenser chamber 88 via openings 96 in lower horizontal partition 83.

Moreover, rear panel 77 has a conically-shaped projection 97 at the height of an upper area of condenser chamber 88; projection 97 extends into the interior of the laundry dryer in a known manner and serves as a deflector for the laundry being tumbled. A lint screen 98 is also integrated in projection 97 in a known manner; lint screen 98 essentially comprises a frame 99, screen-like fabric 100 clamped therein, as well as a handle 101. Lint screen 98 can be slid into unillustrated guide means in projection 97 from above and can be removed by means of handle 101. Handle 101 can also be of recessed design.

Disposed on the rear of projection 97 are openings 102, which provide radial aerodynamic access to condenser chamber 88. A further radial aerodynamic access to condenser chamber 88 is formed by an exhaust opening 103, which is disposed in rear panel 77 just above lower horizontal partition 83. Exhaust opening 103 is displaced relative to the center of door 75, on the right-hand side of door 75, essentially reversed above inlet opening 95, as can clearly be seen from FIG. 9.

A condenser 104, which is designed as a multitubular surface condenser, is arranged in condenser chamber 88. Condenser 104 comprises a battery of tubes 105. Each of tubes 105 has a longitudinal, cylindrical section 106, each end of which transitions into a widened end piece 108 via a conically-shaped flare 107. As can clearly be seen from FIG. 11, end pieces 108 are of hexagonal radial cross section, so that the battery of tubes 105 is formed in that tubes 105 and their end pieces 108 are placed one adjacent to the other in the form of a honeycomb.

Since cylindrical sections 106 of tubes 105 have a narrower diameter than end pieces 108, interspaces 109 are formed between tubes 105. In condenser 104, interspaces 109 form one cavity, while the interiors of tubes 105 form the other cavity.

Cylindrical sections 106 account for virtually the entire length of tubes 105, as widened, hexagonal end pieces 108 serve only to create a secure mechanical union at the ends of tubes 105 and to produce an aerodynamically tight seal. If this seal is well fabricated, it might be possible to eliminate horizontal partitions 82 and 83 if condenser 104 that is formed by the battery of tubes 105 is then molded or otherwise tightly attached at a suitable height in the housing of door 75.

The theory of operation of the arrangement according to FIGS. 9 to 11 is as follows:

In FIG. 10, 115 represents a first airflow, which comprises warm, vapor-laden air from the interior of the laundry dryer. First airflow 115 is circulated in a known manner and enters conically-shaped projection 97 via openings 102. First airflow 115 then flows through lint screen 98 in the conventional manner and then, because conically-shaped projection 97 is not separated from condenser chamber 88, immediately strikes tubes 105 of condenser 104 radially.

Since the opposite side of condenser chamber 88 is defined by front panel 76, after entering condenser 104 first airflow 115 is deflected downward axially (relative to tubes 105), as suggested by arrows in FIG. 10. Airflow 115 now flows axially along cylindrical sections 106 of tubes 105 until it strikes the aerodynamically tight arrangement of lower end pieces 108 of tubes 105, or lower horizontal partition 93, at the bottom end of condenser 104. Consequently, first airflow 115 is again radially deflected toward the interior of the condenser, as exhaust opening 103 at the bottom end of condenser 104 represents an opportunity for first airflow 115 to egress from condenser 104. At this point, airflow 115 can be advanced to a fan and a heating register through an unillustrated duct and returned to the interior of the laundry dryer, as has already been analogously suggested for another practical example in FIG. 2.

A second airflow 116, which comprises the cooling air, is advanced to door 75 by an unillustrated fan and via an unillustrated duct; at door 75, second airflow 116 enters lower air plenum 87 through rear panel 77 via inlet opening 95. In lower air plenum 87, second airflow 116 is deflected upward radially and enters lower end pieces 108 of tubes 105 of condenser 104 through openings 96 in lower horizontal partition 83. If a lower horizontal partition 83 is not disposed, second airflow 116 enters end pieces 108 directly.

Second airflow 116 now axially flows through interiors 110 of tubes 105, i.e. essentially cylindrical sections 106. On its way through interiors 110, the cooling air of second airflow 116 comes into thermally conductive contact with the warm, vapor-laden air of first airflow 115, which is flowing in the opposite direction, via the thin walls of tubes 105, thereby enabling heat exchange to take place. This heat exchange is significantly enhanced through the thin-walled design of tubes 105, as well as the considerable swirling of first airflow 115 in the area of condenser 104.

Second airflow 116 then enters upper air plenum 86 at the upper end of tubes 105 through upper end pieces 108 and openings 94 in upper horizontal partition 82 (if disposed). In upper air plenum 86, second airflow 116 is again radially deflected, leaving door 75 through slits 93 in front panel 76.

The present invention has been described above on the basis of preferred practical examples thereof. Obviously, many modifications and variations of the present invention are possible in the light of the above teachings. It should therefore be understood that, within the scope of the appended claims, the present invention may be practiced otherwise than as specifically described. In particular, individual characteristics of the invention can be employed individually or in combination one with the other.

I claim:

1. A laundry dryer comprising:

a housing having outer panels, said housing having an interior for receiving laundry, said interior being accessible via a door;

a condenser being arranged on one of said outer panels and having an enclosure comprising a first cavity for advancing vapor-laden warm air, a second cavity for advancing a cooling medium and a thermally conductive partition of large surface area separating said cavities, one of said cavities having first and second chambers and a plurality of tubes disposed adjacent to one another, said tubes having first and second open ends for communicating between said first and second chambers respectively, and wherein sections intermediate the ends of the tubes have interspaces therebetween defining the other cavity; and means for blowing said vapor-laden warm air from said interior on the one hand, into said first cavity, and for advancing said cooling medium on the other hand, into said second cavity of said condenser for bringing said vapor-laden warm air and said cooling medium into thermally conductive contact one with the other in said condenser for cooling said vapor-laden warm air.

2. The laundry dryer of claim 1 wherein said one outer panel is a front panel of a door of said laundry dryer and said condenser is integrated in said door.

3. The laundry dryer of claim 1 wherein said first cavity additionally communicates in a thermally conductive manner and throughout a large surface area with an exterior area surrounding said laundry dryer via a thermally conductive front panel of said door.

4. The laundry dryer of claim 1 wherein said second cavity additionally communicates in a thermally conductive manner and throughout a large surface area with an exterior area surrounding said laundry dryer via a thermally conductive front panel of said door.

5. The laundry dryer of claim 1 further comprising means for collecting water having condensed from said cooled vapor-laden air, wherein said collecting means are also integrated in said door.

6. The laundry dryer of claim 1 further comprising a lint screen disposed upstream of said condenser, through which said vapor-laden warm air is advanced, wherein said lint screen is also integrated in said door.

7. The laundry dryer of claim 1 wherein said condenser is thermally insulated from said interior by means of an insulating panel.

8. The laundry dryer of claim 3 wherein said condenser and said door form a single-piece plastic component.

9. The laundry dryer of claim 1 wherein said cooling medium is air and a fan is provided for said air, wherein said fan is integrated in said housing of said laundry dryer above said door.

10. A laundry dryer comprising:

a housing having outer panels, said housing having an interior for receiving laundry, said interior being accessible via a door;

a condenser being arranged on one of said outer panels and having a first cavity for advancing vapor-laden warm air, a second cavity for advancing a cooling medium and a thermally conductive partition of large surface area separating said cavities, said condenser being formed by a plurality of tubes, said tubes being disposed adjacent one to the other with widened ends, while sections thereof extending between said widened ends display interspaces one between the other, and wherein said tubes form one of said cavities and said interspaces form said other cavity; and means for blowing said vapor-laden warm air from said interior, on the one hand, into said first cavity, and or advancing said cooling medium on the other hand, into said second cavity of said condenser for bringing said vapor-laden air and said medium into thermally conductive contact one with the other in said condenser for cooling said vapor-laden air.

11. The laundry dryer of claim 10 wherein said first cavity additionally communicates in a thermally conductive manner and throughout a large surface area with an exterior area surrounding said laundry dryer via a thermally conductive front panel of said door.

12. The laundry dryer of claim 18 wherein said second cavity additionally communicates in a thermally conductive manner and throughout a large surface area with an exterior area surrounding said laundry dryer via a thermally conductive front panel of said door.

13. The laundry dryer of claim 10 wherein said cooling air flows radially against an area of one end of said tubes from said exterior, wherein said airflow is deflected in an axial direction, flows axially along said tubes, is again radially deflected and flows away from said tubes in said radial direction.

14. The laundry dryer of claim 10 further comprising means for collecting water having condensed from said cooled vapor-laden air, wherein said collecting means is also integrated in said door.

15. The laundry dryer of claim 10 further comprising a lint screen disposed upstream of said condenser through which said vapor-laden warm air is advanced, wherein said lint screen is also integrated in said door.

16. The laundry dryer of claim 10 wherein said condenser is thermally insulated from said interior by means of an insulating panel.

17. The laundry dryer of claim 11 wherein the radial cross-sections of said widened ends are of hexagonal configuration.

18. The laundry dryer of claim 10 wherein said cooling medium is air and a fan is provided for said air, wherein said fan is integrated in said door.

19. The laundry dryer of claim 10 wherein said cooling medium is air and a fan is provided for said air, wherein said fan is integrated in said housing of said laundry dryer above said door.

20. A laundry dryer comprising:

a housing having outer panels, said housing having an interior for receiving laundry, said interior being accessible via a door;

a condenser being arranged on an outer front panel of said door, said condenser being integrated in said door, said condenser further having a first cavity for advancing vapor-laden warm air, a second cavity for advancing a cooling medium and having a thermally conductive partition of large surface area separating said cavities one from the other, wherein one of said cavities is formed by a plurality of tubes having first and second open ends and extending through the other cavity, said first open ends of said tubes disposed adjacent one to the other and said second open ends disposed adjacent one to the other; and means for blowing said vapor-laden warm air from said interior, on the one hand into said first cavity, and for advancing said cooling medium, on the other hand, into said second cavity of said condenser for bringing said vapor-laden warm air and said cooling medium into thermally conductive contact with the other in said condenser for cooling said vapor-laden warm air.

21. The laundry dryer of claim 20 wherein said first cavity additionally communicates in a thermally conductive manner and throughout a large surface area with an exterior area surrounding said laundry dryer via a thermally conductive front panel of said door.

22. The laundry dryer of claim 20 wherein said second cavity additionally communicates in a thermally conductive manner and throughout a large surface area with an exterior area surrounding said laundry dryer via a thermally conductive front panel of said door.

23. The laundry dryer of claim 20 wherein said cooling medium comprises air that flows radially against an area of said first ends of said tubes from said exterior, wherein said airflow is deflected in an axial direction, flows axially along said tubes, is again radially deflected and flows out of said second ends away from said tubes in said radial direction.

24. The laundry dryer of claim 20 further comprising means for collecting water having condensed from said cooled vapor-laden air, wherein said collecting means is also integrated in said door.

25. The laundry dryer of claim 20 further comprising a linty screen disposed upstream of said condenser, through which said warm air is advanced, wherein said lint screen is also integrated in said door.

26. The laundry dryer of claim 20 wherein said condenser is thermally insulated from said interior by means of an insulating panel.

27. The laundry dryer of claim 21, wherein said first and second ends of said plurality of tubes are widened and further wherein the radial cross-sections of said widened ends are of hexagonal configuration.

28. The laundry dryer of claim 20 wherein said condenser and said door form a single-piece plastic component.

29. The laundry dryer of claim 20 wherein said cooling medium is air and a fan is provided for said air, wherein said fan is integrated in said door.

30. The laundry dryer of claim 20 wherein said cooling medium is air and a fan is provided for said air, wherein said fan is integrated in said housing of said laundry dryer above said door.

* * * * *

UNITED STATES PATENT AND TRADEMARK OFFICE

CERTIFICATE OF CORRECTION

PATENT NO. : 5,279,047

DATED : January 18, 1994

INVENTOR(S) : Werner Janecke

It is certified that error appears in the above-identified patent and that said Letters Patent is hereby corrected as shown below:

Column 16, line 26, claim 10, "or" should be --for--.

Column 16, line 36, claim 12, "18" should be --10--.

Column 16, line 58, claim 17, "11" should be --10--.

Column 18, line 15, claim 25, "linty" should be --lint--.

Column 18, line 21, claim 27, "21" should be --20--.

Signed and Sealed this

Fifth Day of July, 1994

Bruce Lehman

*Attest:*

BRUCE LEHMAN

*Attesting Officer*

*Commissioner of Patents and Trademarks*